US006290547B2

(12) United States Patent
David et al.

(10) Patent No.: US 6,290,547 B2
(45) **Date of Patent: *Sep. 18, 2001**

(54) RECEPTACLE FOR AN ELECTRICAL CONNECTOR

(75) Inventors: James J. David, Mechanicsburg, PA (US); Alan Raistrick, Rockville, MD (US); Wayne G. Weigard, Parkland, FL (US)

(73) Assignee: Berg Technologies, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/224,140

(22) Filed: Dec. 31, 1998

(51) Int. Cl.[7] ..... H01R 13/502; H01R 13/514; H01R 13/73

(52) U.S. Cl. ..... 439/701; 439/943

(58) Field of Search ..... 439/701, 62, 79, 439/590, 637, 873, 943, 752, 634; 29/884

(56) References Cited

U.S. PATENT DOCUMENTS

| | | | | |
|---|---|---|---|---|
| 3,530,422 | | 9/1970 | Goodman . | |
| 4,156,553 | | 5/1979 | Ammon et al. . | |
| 4,188,715 | | 2/1980 | Ammon et al. . | |
| 4,269,468 | | 5/1981 | Ammon et al. . | |
| 4,274,691 | * | 6/1981 | Abernethy et al. | 439/507 |
| 4,391,482 | | 7/1983 | Czeschka . | |
| 5,213,514 | | 5/1993 | Aral . | |
| 5,639,269 | * | 6/1997 | Vanbasian et al. | 439/741 |
| 5,820,393 | * | 10/1998 | Edgley et al. | 439/181 |

* cited by examiner

*Primary Examiner*—Brian Sircus
*Assistant Examiner*—Chandrika Prasad
(74) *Attorney, Agent, or Firm*—Perman & Green, LLP

(57) ABSTRACT

A receptacle for an electrical connector which comprises an elongated insulative housing having parallel lateral walls, parallel end walls and base wall. An interior cavity is formed by those walls, and a longitudinal groove extends between the longitudinal walls from adjacent one of said end walls to the other end wall. At least one conductive contact having a base end and a distal end extends upwardly through the base wall and then in the interior cavity. A wafer having a hardness greater than the base wall is positioned beneath the base wall to enhance dimensional stability of the receptacle in a vertical or other direction perpendicular to the substrate on which the receptacle is mounted.

22 Claims, 4 Drawing Sheets

RECEPTACLE FOR AN ELECTRICAL CONNECTOR

CROSS REFERENCE TO RELATED APPLICATIONS

This application is related to application Ser. No. 09/224,142 entitled "ELECTRICAL CONNECTOR WITH TERMINAL LOCATION CONTROL FEATURE" and to application Ser. No. 09/224,383 entitled "METHOD OF MANUFACTURING AN EXTENDED HEIGHT INSULATIVE HOUSING FOR AN ELECTRICAL CONNECTOR", both filed on Dec. 31, 1998 and which are incorporated herein by reference.

BACKGROUND OF THE INVENTION

1. Field of the Invention

The present application relates to electrical connectors and more particularly to means for enhancing dimensional stability in a vertical direction or other direction perpendicular to a substrate.

2. Brief Description of Prior Developments

In various electrical connectors particular needs require the use of relatively long beams. The physical relationship of the cross sectional area of the beam and its length will make it difficult to manage more critical dimensional tolerances. The critical dimensional tolerances in question control the inner relationship between the terminal tail, the retention feature and the contact area of the terminal. An example of such an electrical connector is a receptacle used on a single connect attach (SCA) disk drive interface.

Particularly when a soft insulating material is used in the connector housing, the connector may tend to be dimensionally deformed in the vertical direction or other dimension perpendicular to the printed circuit board (PCB) or other substrate on which the connector is being mounted. As a result of such dimensional instability it is often necessary that the housing be designed with significant additional height from the top of the terminals to the top of the housing as a safety factor.

Such lack of dimensional stability may also be important when two terminals are mated in a first mate, last brake sequence. For example, such a sequence may be employed to allow for initial grounding, particularly at low voltages, to minimize component burn out. If a connector is dimensionally unstable in the direction perpendicular to the PCB or other substrate, the correct mating and unmating sequence may be lost.

There is, therefore, a need for means for controlling dimensional stability of an electrical connector in a vertical direction or other direction perpendicular to a PCB or other substrate.

SUMMARY OF THE INVENTION

The present invention is a receptacle for an electrical connector which comprises an elongated insulative housing having parallel lateral walls, parallel end walls and base wall. An interior cavity is formed by those walls, and a longitudinal groove extends between the longitudinal walls from adjacent one of said end walls to the other end wall. At least one conductive contact having a base end and a distal end extends upwardly through the base wall and then in the interior cavity. A wafer or other means harder than the insulative housing and in particular the base wall is positioned beneath the base wall to help maintain dimensional stability in a vertical direction or in another direction perpendicular to a PCB or other substrate.

Also encompassed by this invention is a method for mounting an electrical connector on a PCB or other substrate to minimize dimensional instability in a direction perpendicular to the substrate. A wafer having a hardness greater than the hardness of the insulative housing and in particular the base wall of the housing is interposed between the connector and the substrate.

BRIEF DESCRIPTION OF THE DRAWINGS

The connector of the present invention is further described with reference to the accompanying drawings in which.

DETAILED DESCRIPTION OF THE PREFERRED EMBODIMENTS

Figure 1:
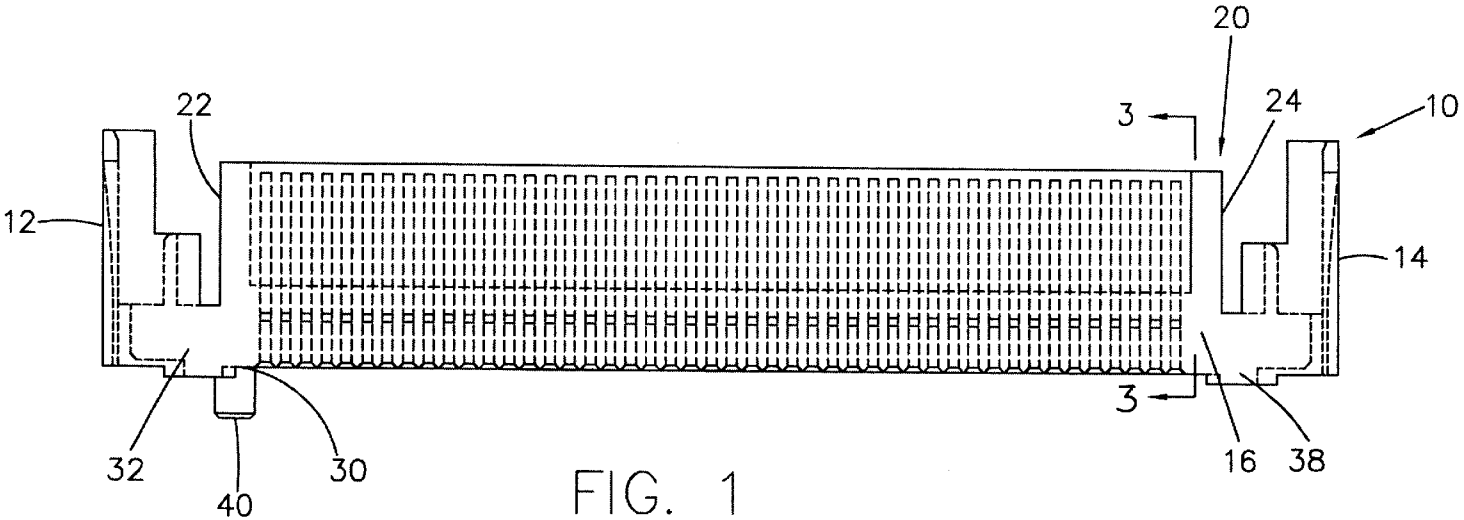
FIG. 1 is a side elevational view of a preferred embodiment of the connector of the present invention.
Figure 2:
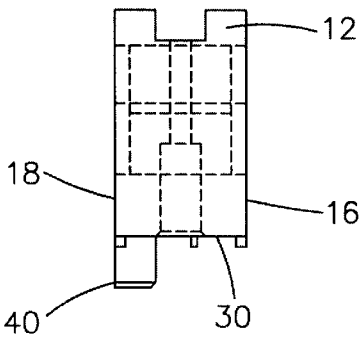
FIG. 2 is an end view of the connector shown in FIG. 1.
Figure 3:
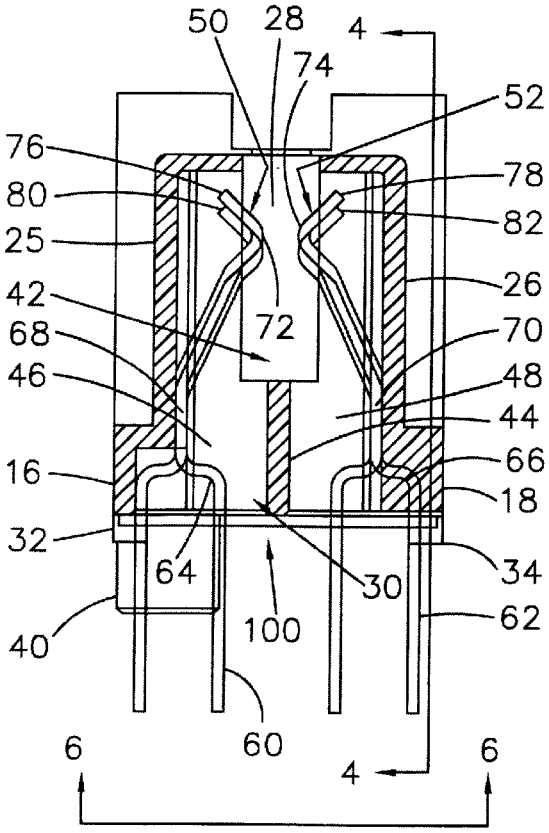
FIG. 3 is a cross sectional view through 3—3 in FIG. 1.

Referring to FIGS. 1–4, the receptacle of the present invention includes an insulative housing shown generally at numeral 10. This housing has a first end wall 12 and a second end wall 14 which are connected by a first lateral wall 16 and a second lateral wall 18. The housing also includes an upper plug receiving structure shown generally at numeral 20. This upper receiving structure is made up of a first end wall extension 22 and a second end wall extension 24 which are connected by a first lateral wall extension 25 and a second lateral wall extension 26 that form a medial plug receiving channel 28. The housing also includes a base wall 30 with downward insulation protuberances 32, 34, 36 and 38 and a positioning peg 40.

Figure 4:
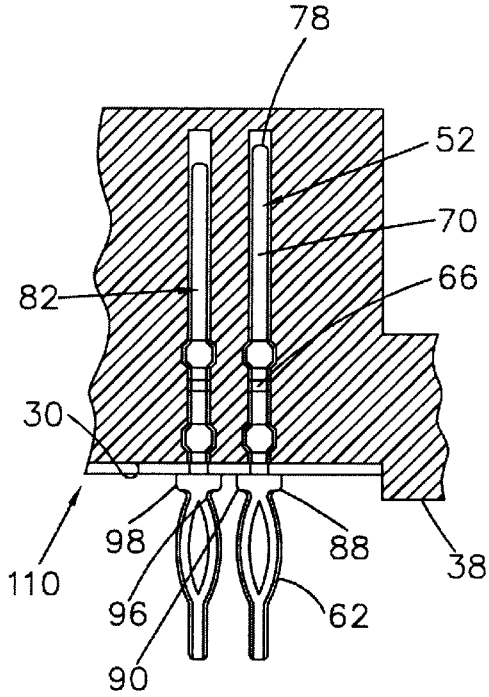
FIG. 4 is a cross sectional view through 4—4 in FIG. 3.
Figure 5:
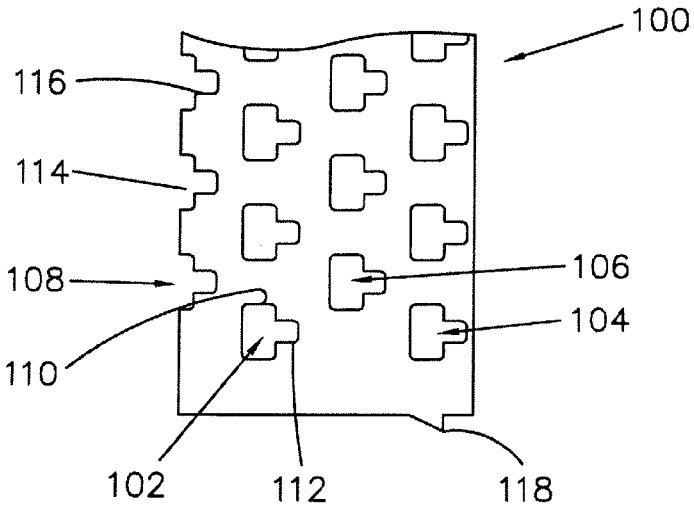
FIG. 5 is a top plan view in fragment of the wafer used in the connector shown in FIG. 1.
Figure 6:
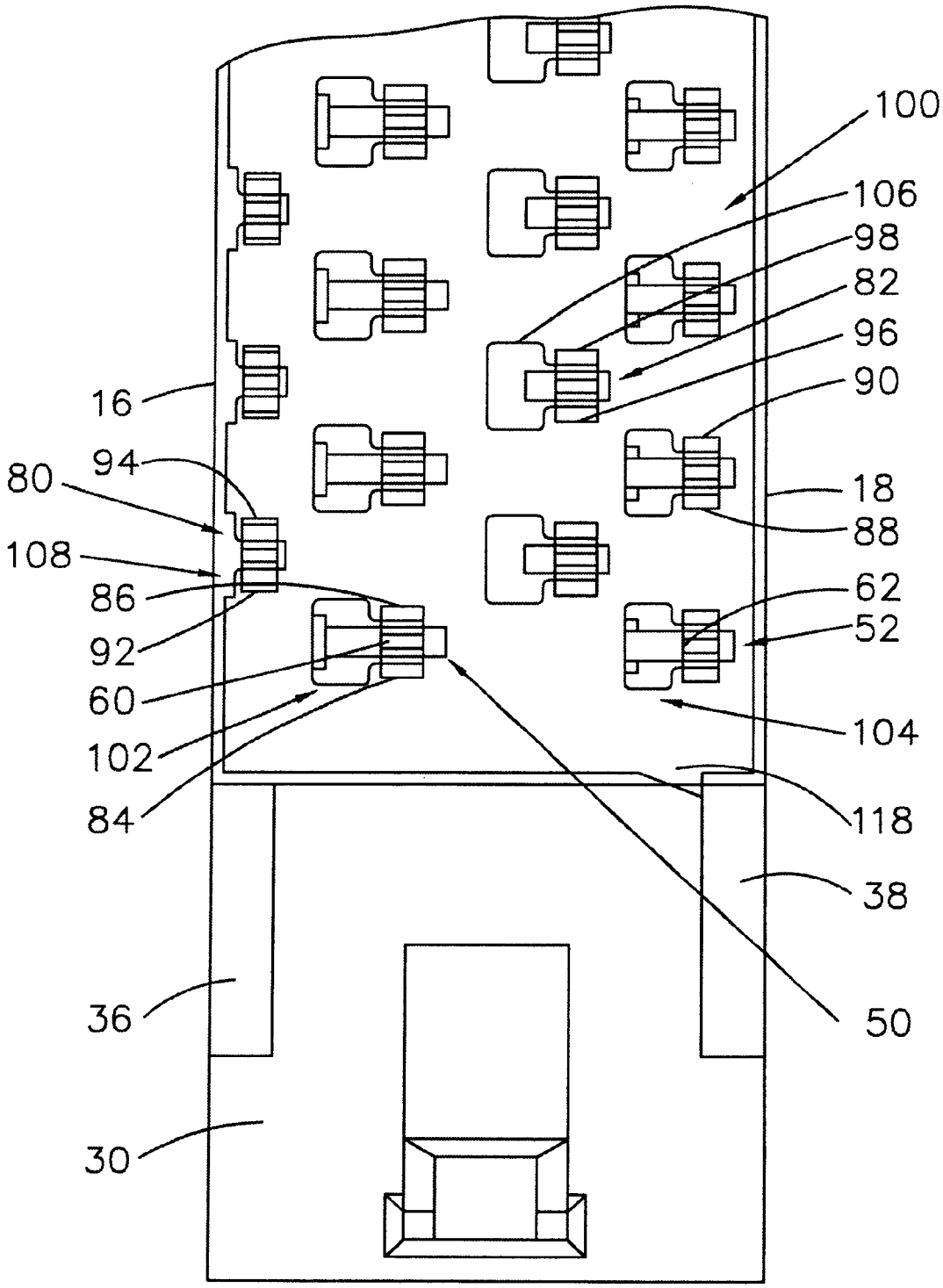
FIG. 6 is a view from 6—6 in FIG. 3.
Figure 7:
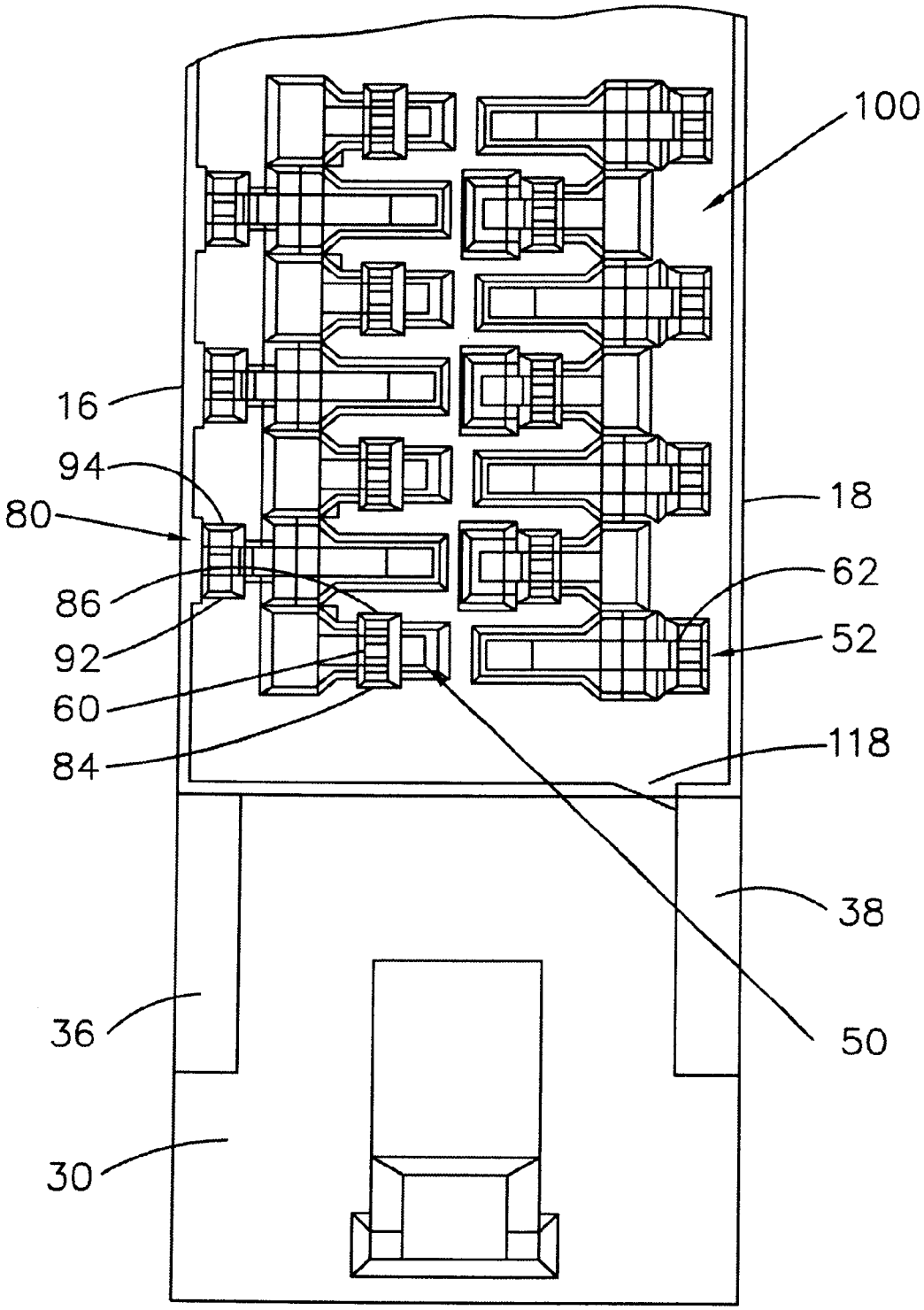
FIG. 7 is a view similar to FIG. 6 showing detail beneath the wafer.

Referring particularly to FIGS. 3–7, an interior cavity 42 is formed between the first lateral wall 16 and the lateral wall 18 and beneath the plug receiving channel 28, also referred to herein as a longitudinal groove. Inside this cavity and between the exterior lateral walls there is a medial interior longitudinal wall 44 which separates the interior cavity 42 into a first terminal retaining section 46 and a second terminal retaining section 48. In these sections there are respectively a first terminal 50 and a second terminal 52. The terminals 50 and 52 have respectively lower vertical sections 60 and 62, also referred to herein as the base ends of the terminals, interior lateral sections 64 and 66, and interior arcuate sections 68 and 70. At the end of the arcuate sections the terminals 50 and 52 have respectively contacts 72 and 74 and distal ends 76 and 78 which are adjacent the longitudinal groove. Adjacent terminal 50 there is a third terminal 80. Adjacent terminal 52 there is a fourth terminal 82. Referring particularly to FIGS. 4, 6 and 7, terminal 50 has shoulders 84 and 86, the shoulders also being referred to herein as reinforcement bearing sections. Terminal 52 has shoulders 88 and 90. Terminal 80 has shoulders 92 and 94. Terminal 82 has shoulders 96 and 98. Interposed between these shoulders and the base wall 30 of the insulative housing there is a wafer, also referred to herein as a reinforcement, shown generally at numeral 100. This wafer is preferably ceramic but it also may be a polymer having a hardness which is greater than the insulative housing and particularly the base wall 30 or it may be a composite such as FR-4 circuit board material.

Referring particularly to FIGS. 5–7, the wafer has a plurality of apertures as at aperture 102, 104 and 106. It also has a plurality of edge recesses as at recess 108. The apertures have a wide section 110 where the terminals are initially engaged with the wafer and a narrow section as at section 112 where the shoulders of each of the terminals come to bear against the wafer to fix the wafer beneath the insulative housing. Each of the recesses also has a wide section as at section 114 and a narrow section as at 116 which serve an analogous function as their corresponding sections in the apertures. After the wide part of the apertures are engaged by the terminals, the wafer is moved in the direction of the arrow 300 on FIG. 6 to engage the narrow part of the apertures. At each end of the wafer there is also a tooth as at tooth 118 which scores the plastic of the housing to further secure the wafer beneath the housing.

It will be appreciated that a means has been described for efficiently and inexpensively controlling dimensional stability of an electrical connector in a vertical or other direction perpendicular to a substrate.

The receptacle described herein may be advantageously used on a single connect attach (SCA) disk drive interface.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A receptacle for an electrical connector comprising:

(a) an elongated insulative housing having parallel lateral walls, parallel end walls and a base wall to form an interior cavity and a longitudinal groove extending between said lateral walls from adjacent one of said end walls to the other of said end walls;

(b) at least one conductive terminal having a base end, a distal end extending upwardly from the base end through the base wall and then in the interior cavity of the housing to the distal end, and a reinforcement bearing section between the base end and the distal end; and (c) a reinforcement for the base wall of the insulative housing, said reinforcement having a hardness greater than said base wall and being positioned beneath said base wall to enhance dimensional stability of said receptacle, wherein the reinforcement bearing section of the at least one conductive terminal bears against the reinforcement to fix the reinforcement against the base wall.

2. The receptacle of 1 wherein the hardened reinforcement is a wafer.

3. The receptacle of claim 2 wherein the base wall has a hardness and the wafer has a hardness and the hardness of the wafer is greater than the hardness of the base wall.

4. The receptacle of claim 3 wherein the terminal is fixed to the wafer.

5. The receptacle of claim 4 wherein there is at least one aperture in the wafer and the terminal extends downwardly through said aperture in the wafer.

6. The receptacle of claim 5 wherein the terminal has at least one protuberance extending laterally below the wafer to fix the wafer below the base wall.

7. The receptacle of claim 6 wherein the reinforcement bearing section of the terminal comprises a pair of shoulders below the wafer to fix the wafer below the base wall.

8. The receptacle of claim 7 wherein the shoulders extend beyond the aperture to bear against the wafer.

9. The receptacle of claim 8 wherein the aperture has a widened section and a narrow section and the shoulders of the terminals bear against the wafer adjacent the narrow section.

10. The receptacle of claim 9 wherein the terminal is initially engaged with the wafer at the widened section of the aperture.

11. The receptacle of claim 10 wherein the shoulders of the terminals are subsequently brought to bear against the wafer adjacent the narrow section of the aperture.

12. The receptacle of claim 11 wherein the wafer has an insulation scoring tooth for attachment to the housing.

13. The receptacle of claim 2 wherein the wafer is ceramic.

14. The receptacle of claim 1 wherein the conductive terminal extends upwardly such that the distal end of the terminal is adjacent the longitudinal groove.

15. The receptacle of claim 1 wherein there is a second conductive terminal having a base end and a distal end extending upwardly in the internal cavity from the base end adjacent the base wall.

16. The receptacle of claim 15 wherein a medial longitudinal wall is interposed between the lateral walls in the interior cavity.

17. The receptacle of claim 16 wherein the first and second terminals are positioned on opposed sides of the medial wall.

18. The receptacle of claim 17 wherein the longitudinal groove is superimposed over the medial wall.

19. A receptacle for an electrical connector comprising:

(a) an elongated insulative housing having parallel lateral walls, parallel end walls and a base wall having a hardness to form an interior cavity and longitudinal groove extending between said lateral walls from adjacent one of said end walls to the other of said end walls;

(b) at least one conductive terminal having a pair of lateral shoulders, the terminal extending upwardly first through the base wall and then in the interior cavity of the housing; and (c) a wafer having a hardness greater than said base wall and at least one through hole and positioned beneath the base wall of the housing such that the conductive terminal passes through the through hole and the shoulders of the terminals bear upwardly directly against the wafer to retain the wafer against the base wall whereby the dimensional stability of said receptacle is enhanced.

20. A method for mounting an electrical connector having an insulative housing having a specific hardness on a substrate to minimize dimensional instability in a direction substantially perpendicular to the substrate comprising the steps of interposing a wafer having a hardness between the electrical connector and the substrate, wherein the hardness of the wafer is greater than the hardness of the insulative housing; and terminals of the electrical connector directly contacting the wafer and bearing against the wafer to fix the wafer against the housing of the electrical connector.

21. The method of claim 20 further comprising the step, after the step of interposing, of moving the wafer in a direction transverse to a longitudinal axis of the terminals in order to engage the terminals with the wafer.

22. The method of claim 20 further comprising the steps, after the step of interposing, of:

moving the connector in a direction perpendicular to the wafer in order to engage the terminals in a wide portion of a corresponding aperture in the wafer; and moving the wafer in a direction transverse to a longitudinal axis of the terminals in order to engage the terminals in a narrow portion of each aperture, wherein each shoulder of each terminal comes to bear against the wafer to fix the wafer beneath the insulative housing.

* * * * *